US006487381B1

(12) United States Patent
Ishizuka et al.

(10) Patent No.: US 6,487,381 B1
(45) Date of Patent: Nov. 26, 2002

(54) FIXING APPARATUS IN WHICH HEATING CONDITIONS CAN BE CHANGED IN ACCORDANCE WITH TEMPERATURE OF RELEASING OIL

(75) Inventors: Jiro Ishizuka, Numazu; Takashi Fujita; Keisuke Inoue, both of Shizuoka-ken; Shozo Shimada, Nobeoka, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/628,021

(22) Filed: Jul. 28, 2000

(30) Foreign Application Priority Data

Jul. 30, 1999 (JP) ..... 11-217168

(51) Int. Cl.[7] ..... G03G 15/20

(52) U.S. Cl. ..... 399/67; 399/68; 399/69; 399/325

(58) Field of Search ..... 399/67–70, 324–326, 399/44; 219/216; 432/60; 118/60

(56) References Cited

U.S. PATENT DOCUMENTS

| | | | | |
|---|---|---|---|---|
| 4,087,676 A | | 5/1978 | Fukase | 219/216 |
| 4,193,681 A | * | 3/1980 | Tanigawa et al. | 399/325 |
| 4,563,073 A | | 1/1986 | Reynolds | |
| 5,463,457 A | | 10/1995 | Takeuchi et al. | |
| 5,563,695 A | | 10/1996 | Sakurai et al. | |
| 5,608,508 A | | 3/1997 | Kumagai et al. | 399/339 |
| 5,729,818 A | | 3/1998 | Ishizuka et al. | 399/400 |
| 5,903,799 A | | 5/1999 | Saito et al. | 399/69 |
| 5,966,578 A | | 10/1999 | Soutome et al. | 399/333 |
| 6,088,546 A | | 7/2000 | Inoue et al. | 399/45 |

FOREIGN PATENT DOCUMENTS

| | | |
|---|---|---|
| EP | 0 821 289 | 1/1998 |
| JP | 54-8539 | 1/1979 |

* cited by examiner

*Primary Examiner*—William J. Royer
(74) *Attorney, Agent, or Firm*—Fitzpatrick, Cella, Harper & Scinto

(57) ABSTRACT

The present invention provides a fixing apparatus which has a fixing member for fixing an unfixed image onto a recording material, releasing agent applying device for applying a releasing agent to the fixing member, temperature detecting device for detecting a temperature of the releasing agent, and control device for controlling a fixing condition based on a detected temperature from the temperature detecting device.

16 Claims, 10 Drawing Sheets

FIXING APPARATUS IN WHICH HEATING CONDITIONS CAN BE CHANGED IN ACCORDANCE WITH TEMPERATURE OF RELEASING OIL

BACKGROUND OF THE INVENTION

1. Field of the Invention

The present invention relates to a fixing apparatus applied to image forming apparatuses such as a copying machine and a printer, particularly to an apparatus for applying a fixing member with a releasing agent.

2. Related Background Art

FIG. 10 shows a fixing apparatus as a background art of the present invention.

As shown in detail in FIG. 10, the fixing apparatus is constituted of a fixing roller 510 as a fixing rotating member which is rotatably disposed, a pressurizing roller 520 as a pressurizing rotating member which is pressed in contact with the fixing roller 510 and rotates, a releasing agent applying apparatus 530 as releasing agent applying means, cleaning apparatuses 540, 550, and the like. Additionally, heaters 560, 570 such as halogen lamps are disposed inside the fixing roller 510 and pressurizing roller 520, respectively. Moreover, thermistors 580, 590 are disposed to abut on the fixing roller 510 and pressurizing roller 520, respectively, and surface temperatures of the fixing roller 510 and pressurizing roller 520 are adjusted by controlling voltages to the heaters 560, 570 via a temperature adjustment circuit.

The releasing agent applying apparatus 530 is constituted of: a releasing agent reservoir 530*a* for containing releasing agents such as silicone oil; pumping rollers 530*b*, 530*c* for pumping the releasing agent from the releasing agent reservoir 530*a*; an applying roller 530*d* for applying the pumped releasing agent to the fixing roller 510; a regulating blade 530*e*, formed of elastic materials such as fluorine rubber, for regulating a releasing agent amount on the applying roller 530*d* to provide a constant amount; and the like. Particularly to realize uniform applying of the fixing roller 510 with the releasing agent, the releasing agent applying apparatus 530 is disposed on the downstream side of the rotation direction of the fixing roller 510 with respect to the thermistor 580.

Therefore, when a recording sheet P is conveyed, the fixing roller 510 and pressurizing roller 520 rotate, and the surface of the fixing roller 510 is applied with silicone oil as the releasing agent. When the recording sheet P passes between the fixing roller 510 and the pressurizing roller 520, the recording sheet is pressurized and heated with substantially constant pressure and temperature from both front and back surfaces, an unfixed toner image is fixed and an image is formed on the recording sheet P. Moreover, the recording sheet P with the image fixed thereto is separated from the pressurizing roller 520 by a lower separating pawl 680 and discharged to the outside.

However, this apparatus has the following problem.

Namely, the general thermal fixing apparatus in a copying machine or the like is on standby for a predetermined time after power is turned on until the fixing roller reaches a predetermined temperature, and a copy enable state is obtained after the fixing roller reaches the predetermined temperature. Fixing properties differ immediately after the copy enable state is obtained (hereinafter referred to as "state of first run in the morning"), and when the apparatus is left on standby in the copy enable state and a predetermined time elapses (hereinafter referred to as "left state"). This is because not only the surface temperature of the fixing roller but also the temperature of the entire fixing apparatus and particularly the temperature of the releasing agent applied to the fixing roller surface differ with the state of first run in the morning and the left state. Namely, in the left state, since fixing roller heat is conducted to the releasing agent via the applying roller and pumping roller, the releasing agent gains a high temperature. In this state, even when the releasing agent is applied to the fixing roller, the fixing roller indicates a little temperature drop.

Additionally, since the releasing agent present between the fixing roller and toner also has a high temperature, the fixing property is enhanced.

On the other hand, in the state of first run in the morning, the temperature of the releasing agent is low. When the low-temperature releasing agent is applied to the fixing roller surface, the temperature of the fixing roller rapidly lowers. Additionally, since the low-temperature releasing agent exists between the fixing roller and toner surface, the fixing property is deteriorated. This is further remarkable in a low temperature environment.

SUMMARY OF THE INVENTION

An object of the present invention is to provide a fixing apparatus which performs satisfactory fixing irrespective of temperature of a releasing agent.

Another object of the present invention is to provide a fixing apparatus comprising: a fixing member for fixing an unfixed image onto a recording material; releasing agent applying means for applying a releasing agent to the fixing member; temperature detecting means for detecting temperature of the releasing agent; and control means for controlling a fixing condition in accordance with a detected temperature from the temperature detecting means.

Further objects of the present invention will be apparent in the following description.

DETAILED DESCRIPTION OF THE PREFERRED EMBODIMENTS

Embodiments of the present invention will be described hereinafter with reference to the drawings.

Figure 8:
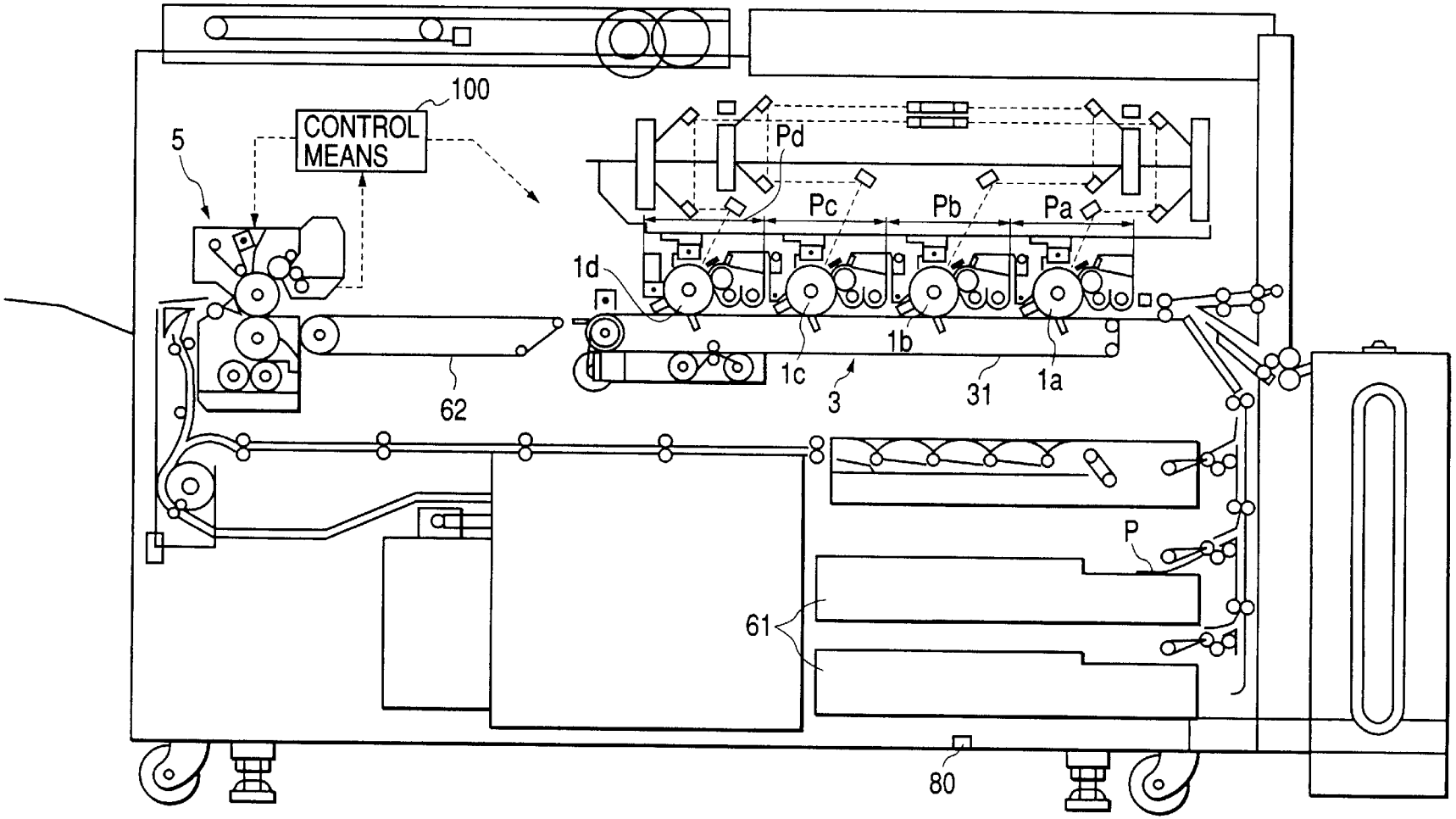
FIG. 8 is a sectional view of an image forming apparatus to which the present invention is applied.
Figure 9:
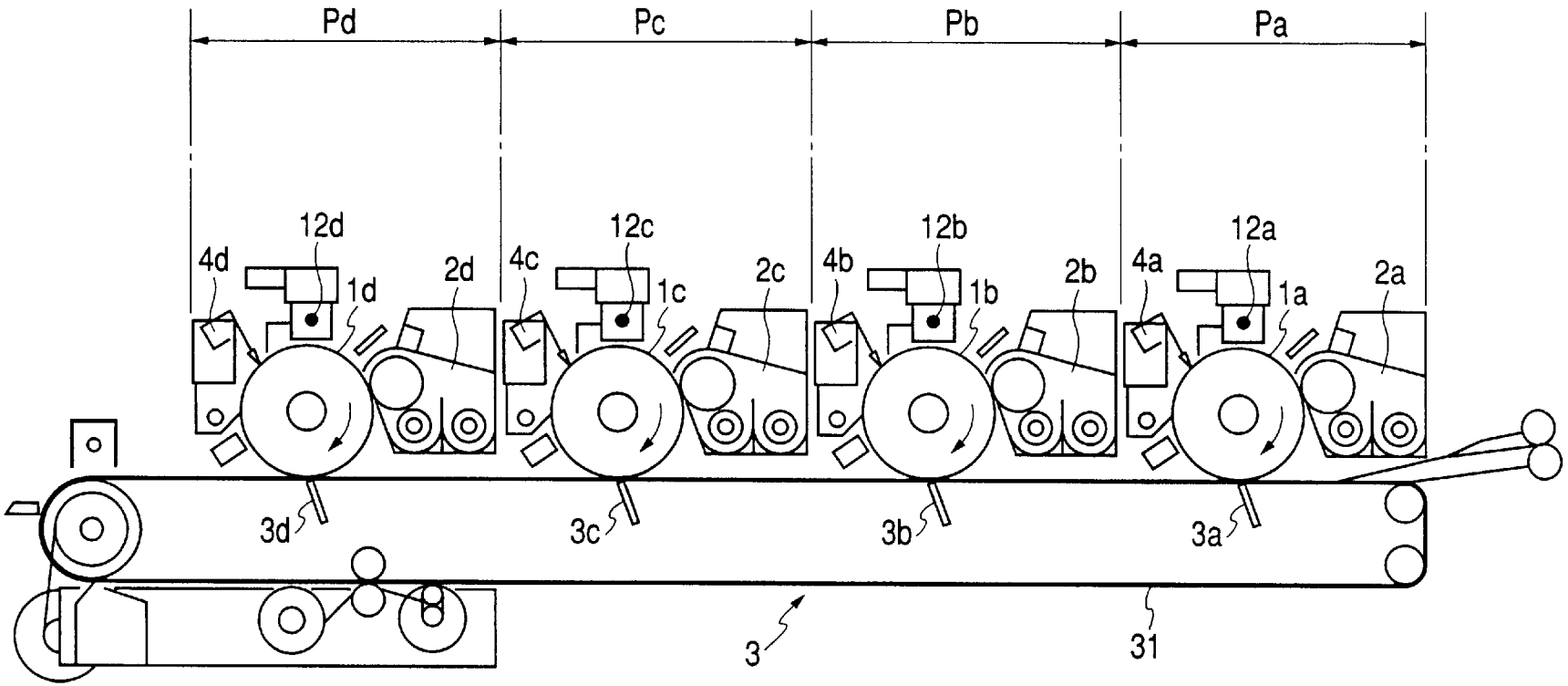
FIG. 9 is a sectional view showing an image forming portion in the image forming apparatus.
Figure 10:
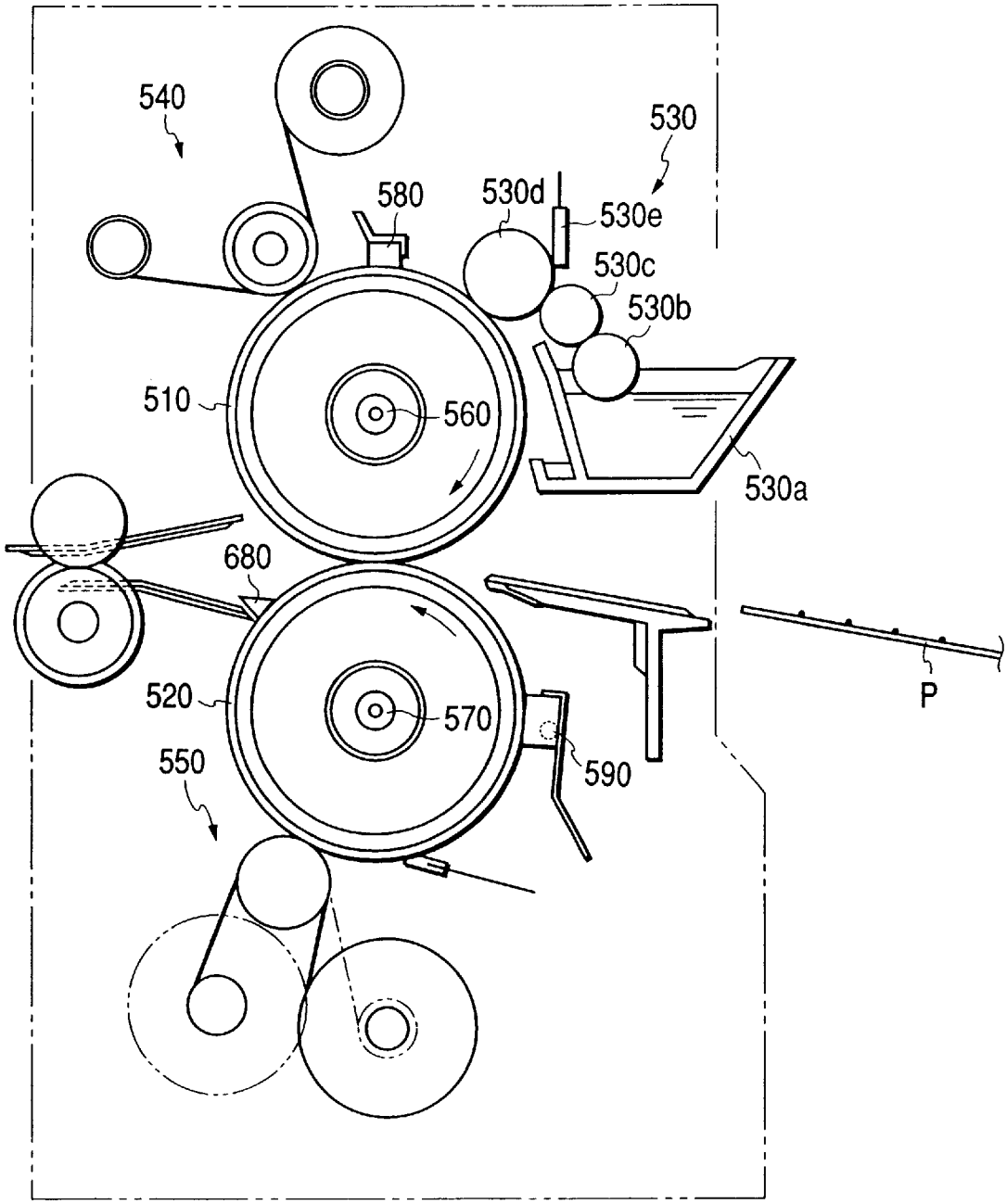
FIG. 10 is a sectional view of a fixing apparatus as a background art of the present invention.

A four-drum laser beam printer provided with a plurality of light scanning means is shown as an image forming apparatus to which the present invention is applied in FIGS. 8 and 9.

Namely, FIG. 8 is a sectional view of an image forming apparatus (laser beam printer), FIG. 9 is a sectional view showing an image forming portion in the image forming apparatus, and as shown in FIG. 8 four image forming stations Pa, Pb, Pc, Pd as image forming means are arranged in line in an apparatus main body.

The image forming stations Pa, Pb, Pc, Pd form images of respective colors of magenta, cyan, yellow, and black, and these are provided with photosensitive drums 1*a*, 1*b*, 1*c*, 1*d* as image bearers rotated in arrow directions shown in FIG. 9, respectively.

Moreover, around the periphery of each photosensitive drum 1*a*, 1*b*, 1*c*, 1*d*, a charging device 12*a*, 12*b*, 12*c*, 12*d*, a developing device 2*a*, 2*b*, 2*c*, 2*d* an a cleaner 4*a*, 4*b*, 4*c*, 4*d* are successively disposed along the rotation direction of each photosensitive drum 1*a*, 1*b*, 1*c*, 1*d*, and a transferring portion 3 is disposed under the respective photosensitive drums 1*a*, 1*b*, 1*c*, 1*d*. Additionally, the transferring portion 3 includes a transferring belt 31 is recording material conveying means common to the respective image forming stations Pa to Pd and transferring charging devices 3*a*, 3*b*, 3*c*, 3*d*.

In the printer constituted as described above, a recording sheet P supplied from a sheet feeding cassette 61 as recording material supply means shown in FIG. 8 is supported on the transferring belt 31, conveyed to the respective image forming stations Pa to Pd, and successively subjected to transferring of the respective colors of toner images formed on the respective photosensitive drums 1*a* to 1*d*. Subsequently, when this transferring process ends, the recording sheet P is separated from the transferring belt 31 and conveyed to a fixing apparatus 5 by a conveying belt 62 as recording material guide means.

Figure 1:
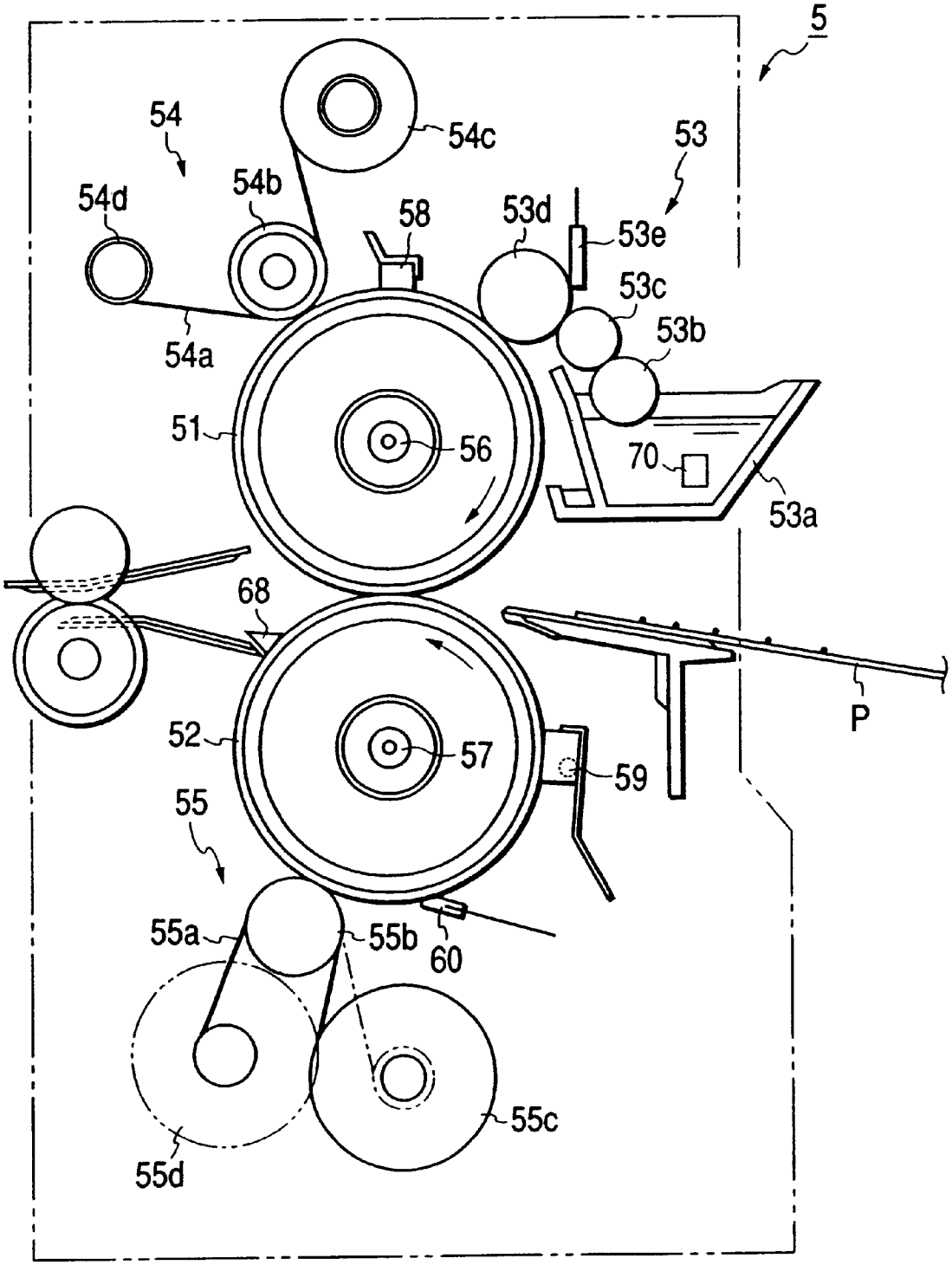
FIG. 1 is a sectional view of a fixing apparatus according to an embodiment of the present invention.

As shown in detail in FIG. 1, the fixing apparatus 5 is constituted of a fixing roller (fixing rotating member) 51 as a rotatably disposed fixing member, a pressurizing roller (pressurizing rotating member) 52 as a separate fixing member which is pressed in contact with the fixing roller 51 and rotates, a releasing agent applying apparatus 53 as releasing agent applying means, and cleaning apparatuses 54, 55. Additionally, heaters 56, 57 such as halogen lamps are disposed inside the fixing roller 51 and pressurizing roller 52, respectively. Moreover, thermistors 58, 59 are disposed to abut on the fixing roller 51 and pressurizing roller 52, respectively, and surface temperatures of the fixing roller 51 and pressurizing roller 52 are adjusted by controlling voltages to the heaters 56, 57 via a temperature adjustment circuit.

The cleaning apparatus 54 and releasing agent applying apparatus 53 are attached to the fixing roller 51, the cleaning apparatus 54 cleans toner or the like offset on the fixing roller 51, and the releasing agent applying apparatus 53 applies releasing agents such as silicone oil to the fixing roller 51, so that separating of the recording sheet P from the fixing roller 51 is facilitated and the toner is prevented from being offset.

The cleaning apparatus 54 is constituted of a cleaning web 54*a* of a strip-shaped heat-resistant non-woven cloth, a pressing roller 54*b* for pressing the cleaning web 54*a* onto the fixing roller 51, an unwinding roller 54*c* for feeding a new cleaning web 54*a*, and a wind-up roller 54*d* for gradually winding up the cleaning web 54*a* whose cleaning ability is deteriorated by an adhering toner or the like. The cleaning apparatus 54 is disposed on the upstream side of the rotation direction of the fixing roller 51 with respect to the thermistor 58 particularly to prevent the offset toner from adhering to the thermistor 58 or from causing detection defect in the thermistor 58.

Additionally, a method of winding up the cleaning web 54*a* comprises turning on a solenoid (not shown) when a counter judges that a predetermined number of sheets are copied, and operating a one-way clutch to wind up a predetermined amount of the cleaning web in a direction reverse to the rotation direction of the fixing roller 51. By winding up the cleaning web 54*a* in the reverse direction, the cleaning web 54*a* is prevented from being wound in the rotation direction of the fixing roller 51.

Moreover, the releasing agent applying apparatus 53 is constituted of: a releasing agent reservoir 53*a* for containing releasing agents such as silicone oil; pumping rollers 53*b*, 53*c* for pumping the releasing agent from the releasing agent reservoir 53*a*; an applying roller 53*d* for applying the pumped releasing agent to the fixing roller 51; and a regulating blade 53*e*, formed of elastic materials such as fluorine rubber, for regulating a releasing agent amount on the applying roller 53*d* to provide a constant amount. Particularly to realize uniform applying of the fixing roller 51 with the releasing agent, the releasing agent applying apparatus 53 is disposed on the downstream side of the rotation direction of the fixing roller 51 with the respect to the thermistor 58.

On the other hand, similarly as the cleaning apparatus 54 of the fixing roller 51, a cleaning apparatus 55 constituted of a cleaning web 55*a*, pressing roller 55*b*, unwinding roller 55*c*, and a wind-up roller 55*d*, and the like is also attached to the pressurizing roller 52, and the cleaning apparatus 55 performs cleaning of the toner adhering to the pressurizing roller 52 via the fixing roller 51.

Moreover, the pressurizing roller 52 abuts on a releasing agent removing blade 60 as a releasing agent removing elastic member for removing an excess releasing agent remaining on the pressurizing roller 52. Additionally, when there is no releasing agent removing blade 60, an excess releasing agent is stored in a nip of the fixing roller 51 and pressurizing roller 52, the recording sheet P is stained, or an OHP transparent laminate film slips and failure occurs in approach to the nip. Here, for the releasing agent removing blade 60, Si rubber, fluorine rubber, or the like is used as a material, and the releasing agent removing blade 60 abuts on the pressurizing roller 52 with an appropriate approach amount in a forward or backward direction with respect to the rotation direction of the pressurizing roller.

Therefore, when the recording sheet P is conveyed, the fixing roller 51 and pressurizing roller 52 rotate, and the surface of the fixing roller 51 is applied with silicone oil as the releasing agent. The recording sheet P passes through the nip on which the fixing roller 51 and pressurizing roller 52 are pressurized to abut, the recording sheet is pressurized and heated with substantially constant pressure and temperature from both front and back surfaces, an unfixed toner image is fixed and a full-color image is formed on the recording sheet P. Moreover, the recording sheet P with the image fixed thereto is separated from the pressurizing roller 52 by a lower separating pawl 68 and discharged to the outside.

In the present embodiment, as shown in FIG. 1, a thermistor 70 as temperature detecting means is disposed in the releasing agent reservoir 53*a*. Numeral 100 denotes control means, and the means receives a detected temperature from the thermistor 70 and can control a fixing temperature, pressure in the fixing nip, rotation speeds of the fixing and pressurizing rollers, supply timing of the recording material to the fixing apparatus, and the like. In the present embodiment, as shown in a flowchart of a fixing condition changing control of FIG. 2, control is performed so as to set the fixing temperature to an optimum fixing condition in accordance with the releasing agent temperature detected by the thermistor 70.

Figure 2:
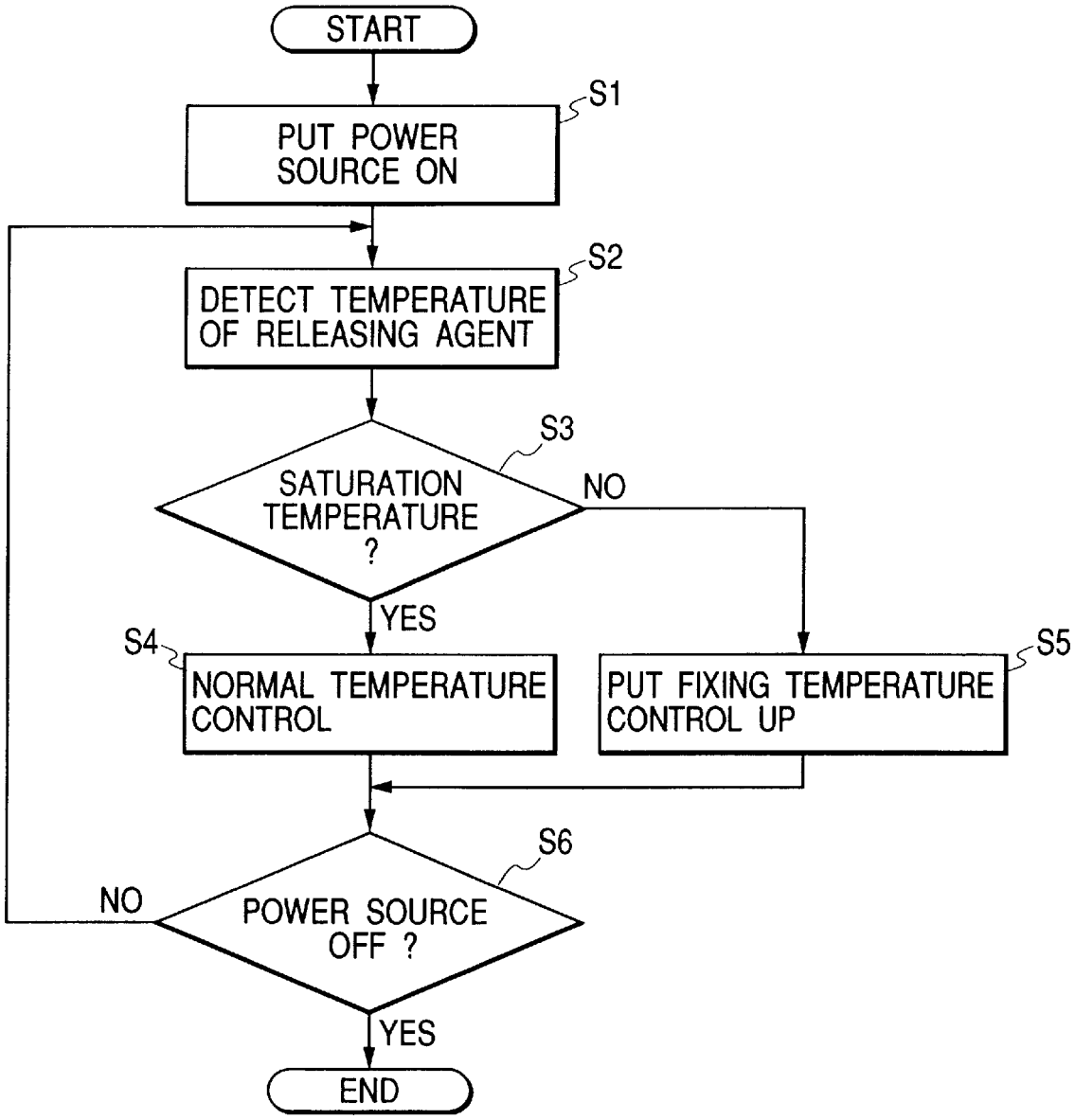
FIG. 2 is a flowchart for changing a set fixing temperature.
Figure 3:
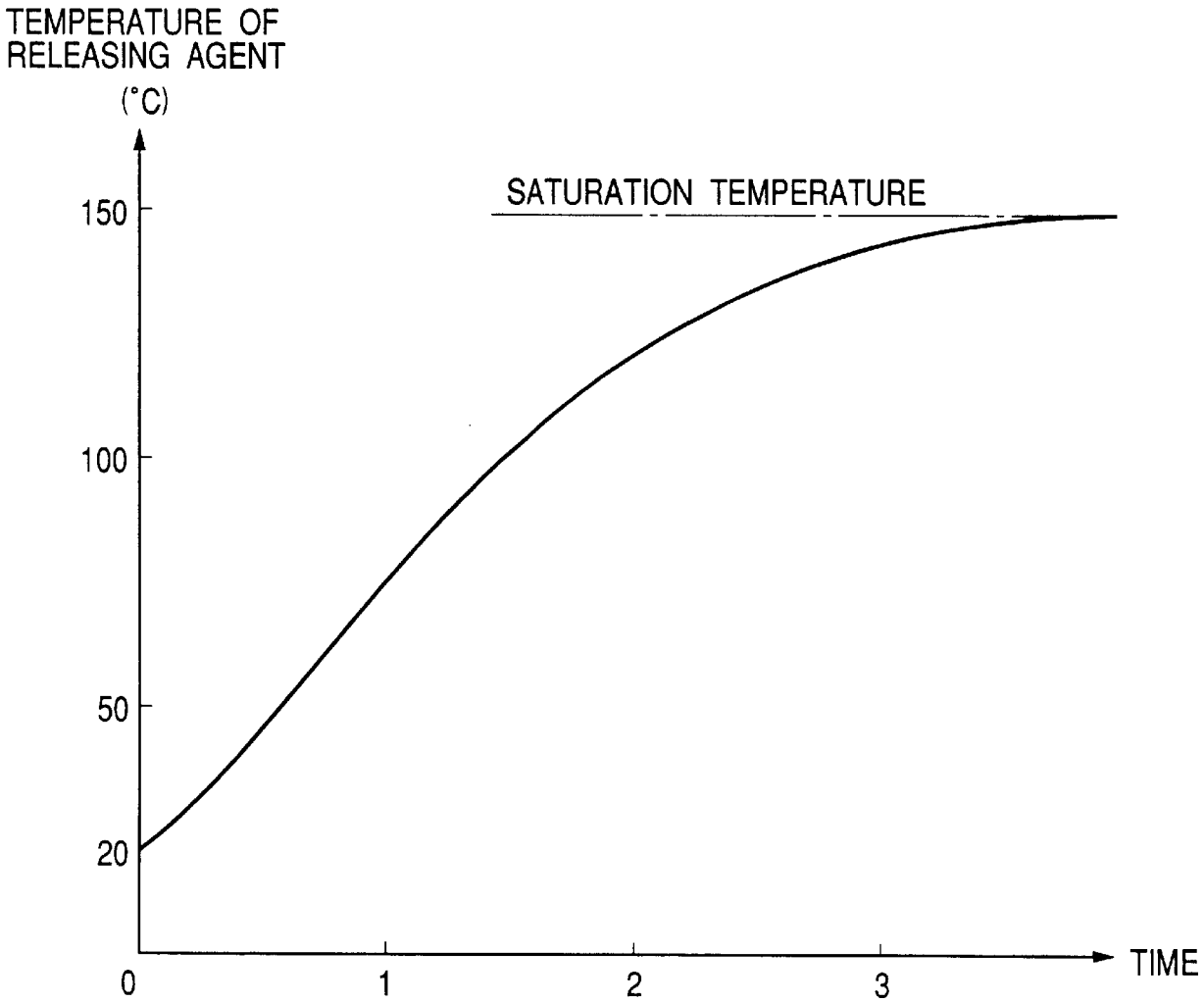
FIG. 3 is a diagram showing a releasing agent temperature rise.

In the present embodiment, as shown in FIG. 2, when a power source is put on (step S1), the thermistor 70 detects the temperature of the releasing agent in the releasing agent reservoir 53*a* at a predetermined interval (step S2). FIG. 3 is a chart showing time and releasing agent temperature change when the surface temperature of the fixing roller 51 is set to 180° C., and as shown in FIG. 3 the releasing agent temperature rises in several hours and is saturated at a certain temperature. Additionally, when the temperature is controlled (adjusted) to provide 180° C. in the fixing apparatus 5 of the present embodiment, the releasing agent temperature is saturated at about 150° C.

Therefore, it is judged whether or not the releasing agent temperature detected by the thermistor 70 reaches a predetermined saturation temperature (step S3). When the temperature reaches the saturation temperature, a usual temperature control is performed. Namely, the temperature control is performed so that the fixing roller reaches a preset standard set temperature (step S4). When the saturation temperature is not obtained, fixing temperature control is put up. Namely, the temperature control is performed so that the set temperature of the fixing roller is higher than the standard set temperature (step S5). The aforementioned operation (operation of steps S2 to S5) is repeated until the power source is turned off (step S6).

As described above, a satisfactory fixing property can be obtained even in the state of first run in the morning by changing the surface temperature of the fixing roller 51 in accordance with the releasing agent temperature. In the fixing apparatus 5 of the present embodiment, with respect to a releasing agent temperature of 10° C., the surface temperature of the fixing roller 51 corresponds to about 1° C. Here, in the state of first run in the morning (several minutes after the power source turns on) the releasing agent temperature is about 30° C., and lower than a saturation temperature of 150° C. by 120° C.

Therefore, for the surface temperature of the fixing roller 51 in the state of first run in the morning, the satisfactory fixing property can be obtained by raising the set temperature only by 12° C. from the left state. Moreover, every time the releasing agent temperature gradually rises, the controlled temperature (set temperature) of the fixing roller 51 is gradually lowered. When the releasing agent temperature is saturated at 150° C., control is performed to return to the normal standard set temperature of the fixing roller. In a conventional type of a machine, irrespective of the releasing agent temperature, means for raising the fixing roller surface temperature only for the predetermined time only in the state of first run in the morning is used. In such control, since an exact time for keeping a high temperature is not known, a time with high temperature has to be lengthened wastefully, power consumption increases, or the life of the fixing roller is adversely affected. In the present system, since a minimum necessary heat is applied, different from the conventional machine, no waste is generated.

Moreover, since the fixing property differs with a peripheral environment temperature or humidity around the machine, by combining detection of the temperature and humidity of an environment where the machine is placed with the present embodiment, a finer control can be performed.

For example, the fixing set temperature can be represented by the following equation by the environment temperature detected using external temperature detecting means 80 and the releasing agent temperature detected using the thermistor 70.

((releasing agent saturation temperature)-(releasing agent detected temperature))/10−(environment temperature)+15

Here, 15 is a correcting value.

With a saturation temperature of 150° C., environment temperature of 15° C., and releasing agent temperature of 50° C., the following equation is obtained, and the set temperature may only be set to be higher than the standard by 10° C.

$$(150-50)/10-15+15=10^\circ\ \text{C.}$$

Similarly, with a saturation temperature of 150° C., environment temperature of 25° C., and releasing agent temperature of 50° C., the following equation is obtained.

$$(150-50)/10-25+15=0^\circ\ \text{C.}$$

Therefore, when the releasing agent temperature is 50° C. in an environment of 25° C., it is unnecessary to set the fixing temperature to be higher than the standard temperature.

Similarly, with a saturation temperature of 150° C., environment temperature of 30° C., and releasing agent temperature of 50° C., the following equation is obtained.

$$(150-50)/10-30+15=-5^\circ\ \text{C.}$$

Here, for a minus value, it is unnecessary to raise the temperature.

Therefore, when the releasing agent temperature reaches 50° C. in the environment of 30° C., it is unnecessary to set the fixing temperature to be higher than the standard temperature.

By detecting the combination of environment temperature and releasing agent temperature in this manner, a finer control can further be performed, and the satisfactory fixing property can be obtained without any waste.

Additionally, since the releasing agent temperature in the present embodiment differs by the constitution of the fixing apparatus or the set temperature of the fixing roller, the value is not necessarily limited.

Another embodiment of the present invention will next be described with reference to FIG. 4. Additionally, FIG. 4 is a flowchart showing the fixing condition changing control procedure in the fixing apparatus of the present embodiment.

Figure 4:
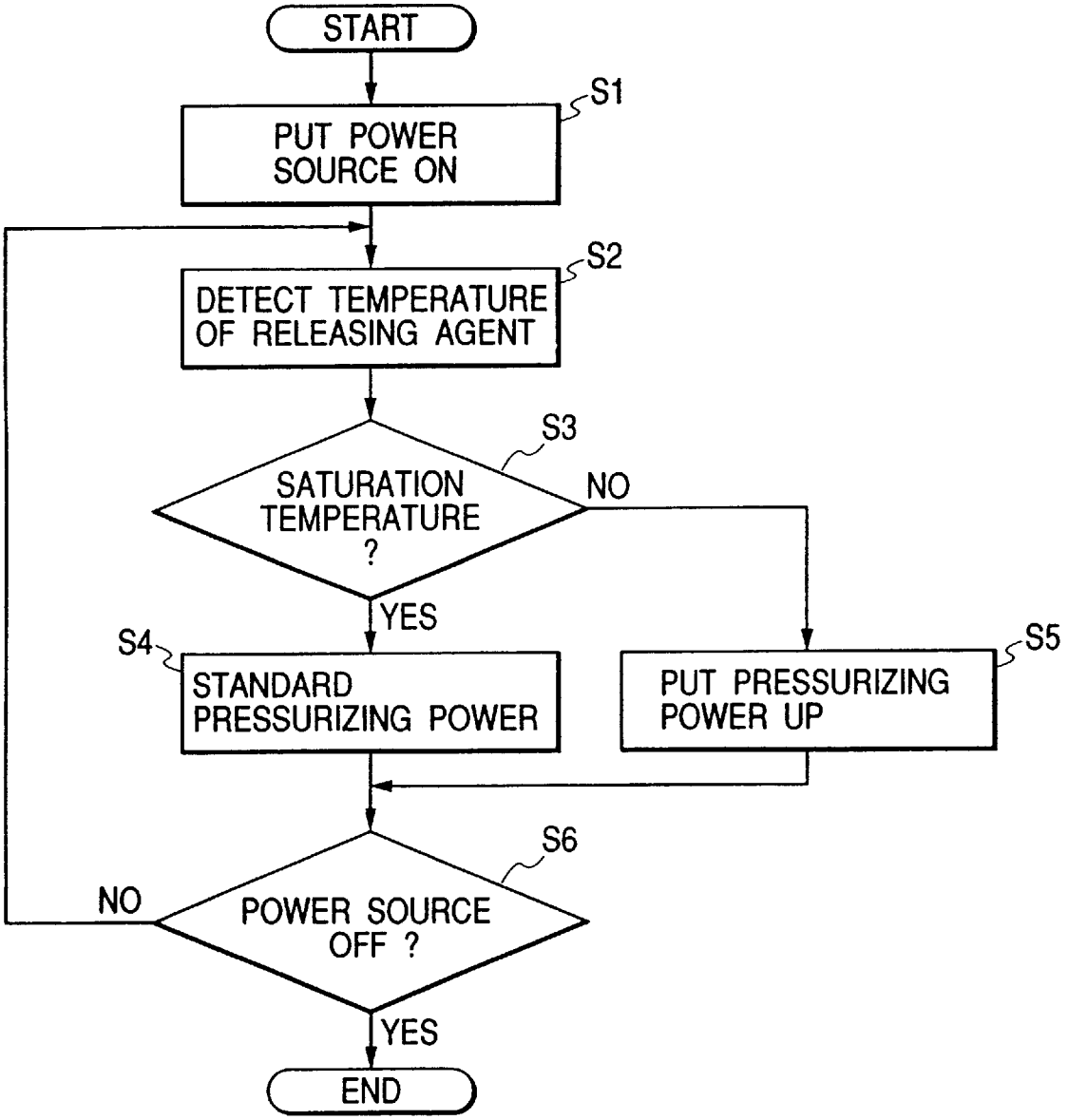
FIG. 4 is a flowchart for changing a pressurizing power.

In the present embodiment, an image forming apparatus similar to that of the aforementioned embodiment is used to perform a control shown in FIG. 4. Namely, in the present embodiment, similarly as the aforementioned embodiment, the thermistor 70 as the temperature detecting means is disposed in the releasing agent reservoir 53*a*, and the control is performed to change a fixing pressurizing power, that is, a pressure in the nip on which the fixing roller and pressurizing roller are pressed to abut in accordance with the releasing agent temperature.

In the present embodiment, means for varying the pressurizing power of the fixing roller 51 and pressurizing roller 52 is disposed. Moreover, as shown in FIG. 4, similarly as the aforementioned embodiment, when the power source is put on (step S1), the thermistor 70 detects the temperature of the releasing agent in the releasing agent reservoir 53*a* at a predetermined interval (step S2). In this case, the releasing agent temperature shows a behavior similar to that shown in FIG. 3. Namely, as shown in FIG. 3 the releasing agent temperature rises in several hours and is saturated at a certain temperature. Additionally, the temperature is saturated at about 150° C. in the fixing apparatus 5 of the present embodiment.

Therefore, it is judged whether or not the releasing agent temperature detected by the thermistor 70 reaches the saturation temperature (step S3). When the temperature reaches the saturation temperature, the pressurizing power of the fixing roller 51 and pressurizing roller 52 are set to a standard pressurizing power (step S4). When the saturation temperature is not obtained, the pressurizing power is put up from the standard pressurizing power (step S5). The aforementioned operation (operation of steps S2 to S5) is repeated until the power source is turned off (step S6).

As described above, the satisfactory fixing property can be obtained even in the state of first run in the morning by changing the pressurizing power of the fixing roller 51 and pressurizing roller 52 in accordance with the releasing agent temperature. In the fixing apparatus 5 used in the present embodiment, with respect to a releasing agent temperature of 10° C., the pressurizing power corresponds to a total pressure of about 1 kgf (≅9.8 N). Here, in the state of first run in the morning the releasing agent temperature is about 30° C., and lower than the saturation temperature of 150° C. by 120° C.

Therefore, for the total pressure of the fixing roller 51 and pressurizing roller 52 in the state of first run in the morning, the satisfactory fixing property can be obtained by raising the pressure by 12 kgf (≅12×9.8=117.6 N) from the left state. Moreover, every time the releasing agent temperature gradually rises, the pressurizing power of the fixing roller 51 and pressurizing roller 52 is gradually lowered. When the releasing agent temperature is saturated at 150° C., the control is performed to return to the normal standard pressurizing power. In the present system, since a minimum necessary pressurizing power is applied, damage of the fixing roller 51 and pressurizing roller 52 can be minimized.

Moreover, since the releasing agent temperature and pressurizing power in the present embodiment differ with a fixing apparatus constitution, the value is not necessarily limited.

Moreover, only the pressurizing power is changed in the present embodiment, but even by combination with the control of the fixing roller temperature of the aforementioned embodiment, a similar effect can be obtained.

Additionally, since the fixing property differs with the environment temperature and humidity around the machine, by further combining detection of the temperature and humidity of the environment where the machine is placed with the present embodiment, a finer control can be performed and the property is further enhanced.

Another embodiment of the present invention will next be described with reference to FIG. 5. Additionally, FIG. 5 is a flowchart showing the fixing condition changing control procedure in the fixing apparatus of the present embodiment.

Figure 5:
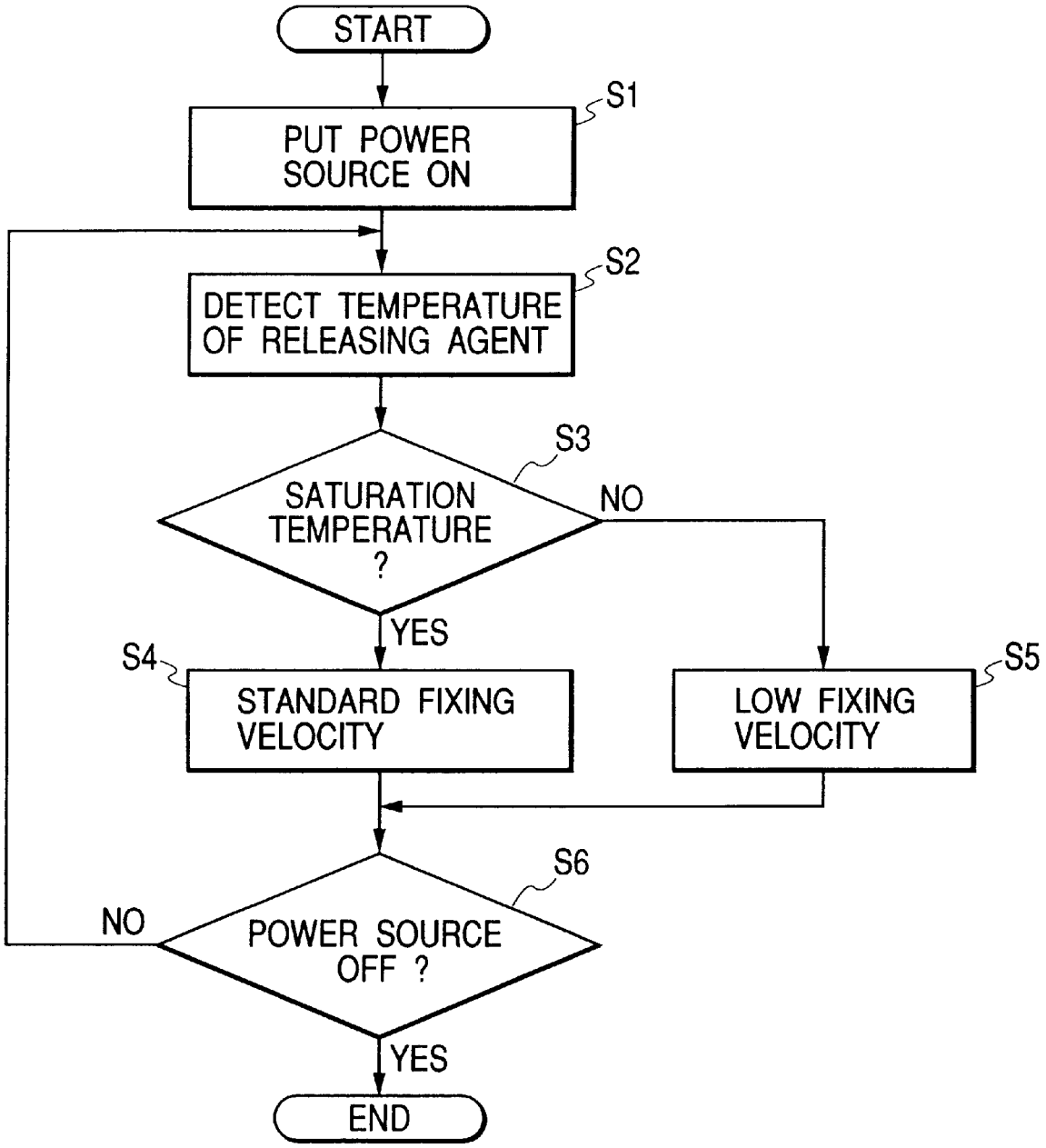
FIG. 5 is a flowchart for changing a fixing velocity.

In the present embodiment, an image forming apparatus similar to that of the aforementioned embodiment is used to perform a control shown in FIG. 5. Namely, in the present embodiment, similarly as the aforementioned embodiment, the thermistor 70 as the temperature detecting means is disposed in the releasing agent reservoir 53*a*, and the control is performed to change a rotation speed of the fixing roller 51 and pressurizing roller 52 in accordance with the releasing agent temperature.

In the present embodiment, as shown in FIG. 5, similarly as the aforementioned embodiment, when the power source is put on (step S1), the thermistor 70 detects the temperature of the releasing agent in the releasing agent reservoir 53*a* at a predetermined interval (step S2). In this case, the releasing agent temperature shows a behavior similar to that shown in FIG. 3. Namely, as shown in FIG. 3 the releasing agent temperature rises in several hours and is saturated at a certain temperature. Additionally, the temperature is saturated at about 150° C. in the fixing apparatus 5 of the present embodiment.

Therefore, it is judged whether or not the releasing agent temperature detected by the thermistor 70 reaches the saturation temperature (step S3). When the temperature reaches the saturation temperature, the rotation speed (fixing velocity) of the fixing roller 51 and pressurizing roller 52 is set to a standard fixing velocity (step S4). When the saturation temperature is not obtained, the fixing velocity is set to be low and slower than a standard fixing velocity (step S5). The aforementioned operation (operation of steps S2 to S5) is repeated until the power source is turned off (step S6).

As described above, the satisfactory fixing property can be obtained even in the state of first run in the morning by changing the rotation speed of the fixing roller 51 and pressurizing roller 52 in accordance with the releasing agent temperature. Here, in the state of first run in the morning the releasing agent temperature is about 30° C., and lower than the saturation temperature of 150° C. by 120° C.

Therefore, the satisfactory fixing property can be obtained by setting the rotation speed of the fixing roller 51 and pressurizing roller 52 in the state of first run in the morning to be slower than that in the left state. Moreover, every time the releasing agent temperature gradually rises, the rotation speed of the fixing roller 51 and pressurizing roller 52 is gradually raised. When the releasing agent temperature is saturated at 150° C., the control is performed to return to the normal standard fixing velocity. In the present embodiment, since a necessary time for retarding the rotation speed is minimized, the property of a main body can be enhanced.

Additionally, since the releasing agent temperature and rotation speed differ with the constitution of the fixing apparatus, these are not necessarily limited to the values described in the present embodiment.

Moreover, since the fixing property differs with the environment temperature and humidity around the machine, by further combining the detection of the temperature and humidity of the environment where the machine is placed with the present embodiment, a finer control is possible and the property is further enhanced.

Another embodiment of the present invention will next be described with reference to FIG. 6. Additionally, FIG. 6 is a flowchart showing the fixing condition changing control procedure in the fixing apparatus of the present embodiment.

Figure 6:
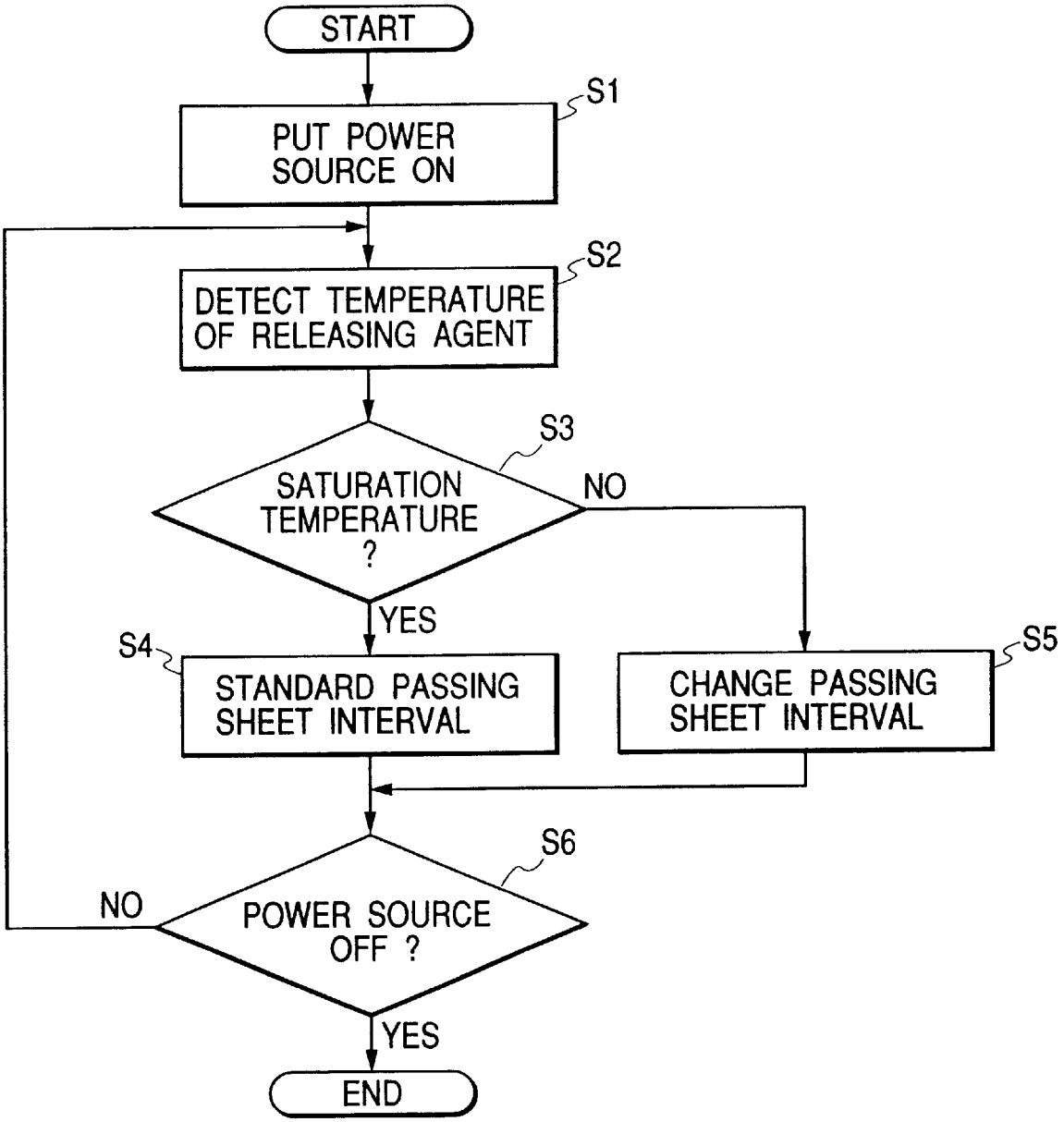
FIG. 6 is a flowchart for changing a passing sheet interval.

In the present embodiment, an image forming apparatus similar to that of the aforementioned embodiment is used and a control is performed as shown in FIG. 6. Namely, in the present embodiment, similarly as the aforementioned embodiment, the thermistor 70 as the temperature detecting means is disposed in the releasing agent reservoir 53*a*, and the control is performed to change a passing sheet interval, that is, the supply timing of the recording material to the fixing apparatus in accordance with the releasing agent temperature.

In the present embodiment, as shown in FIG. 6, similarly as the aforementioned embodiment, when the power source is put on (step S1), the thermistor 70 detects the temperature of the releasing agent in the releasing agent reservoir 53*a* at a predetermined interval (step S2). In this case, the releasing agent temperature shows a behavior similar to that shown in FIG. 3. Namely, as shown in FIG. 3 the releasing agent temperature rises in several hours and is saturated at a certain temperature. Additionally, the temperature is saturated at about 150° C. in the fixing apparatus 5 of the present embodiment.

Therefore, it is judged whether or not the releasing agent temperature detected by the thermistor 70 reaches the saturation temperature (step S3). When the saturation temperature is obtained, the passing sheet interval is set to a standard passing sheet interval (step S4). When the saturation temperature is not obtained, the passing sheet interval is set to be larger than the standard passing sheet interval (step S5). The aforementioned operation (operation of steps S2 to S5) is repeated until the power source is turned off (step S6).

As described above, the satisfactory fixing property can be obtained even in the state of first run in the morning by changing the passing sheet interval in accordance with the releasing agent temperature. Here, in the state of first run in the morning the releasing agent temperature is about 30° C., and lower than the saturation temperature of 150° C. by 120° C.

Therefore, when the passing sheet interval in the state of first run in the morning is set to be larger than that in the left state, a time for recovering the temperature of the fixing roller after fixing one sheet is lengthened, a temperature recovering width of the fixing roller 51 increases, and the satisfactory fixing property can be obtained. Moreover, every time the releasing agent temperature gradually rises, the passing sheet interval is gradually reduced. When the releasing agent temperature is saturated at 150° C., the control is performed to return to the normal standard passing sheet interval. In the present embodiment, by increasing the passing sheet interval and subsequently gradually returning to the standard, wasteful time is minimized and the main body property can therefore be enhanced.

Additionally, since the releasing agent temperature and passing sheet interval differ with the constitution of the fixing apparatus, these are not necessarily limited to the values described in the present embodiment.

Moreover, since the fixing property differs with the environment temperature and humidity around the machine, by further combining the detection of the temperature and humidity of the environment in which the machine is placed with the present embodiment, a finer control is possible and the property is further enhanced.

Another embodiment of the present invention will next be described with reference to FIG. 7. Additionally, FIG. 7 is a flowchart showing the fixing condition changing control procedure in the fixing apparatus of the present embodiment.

Figure 7:
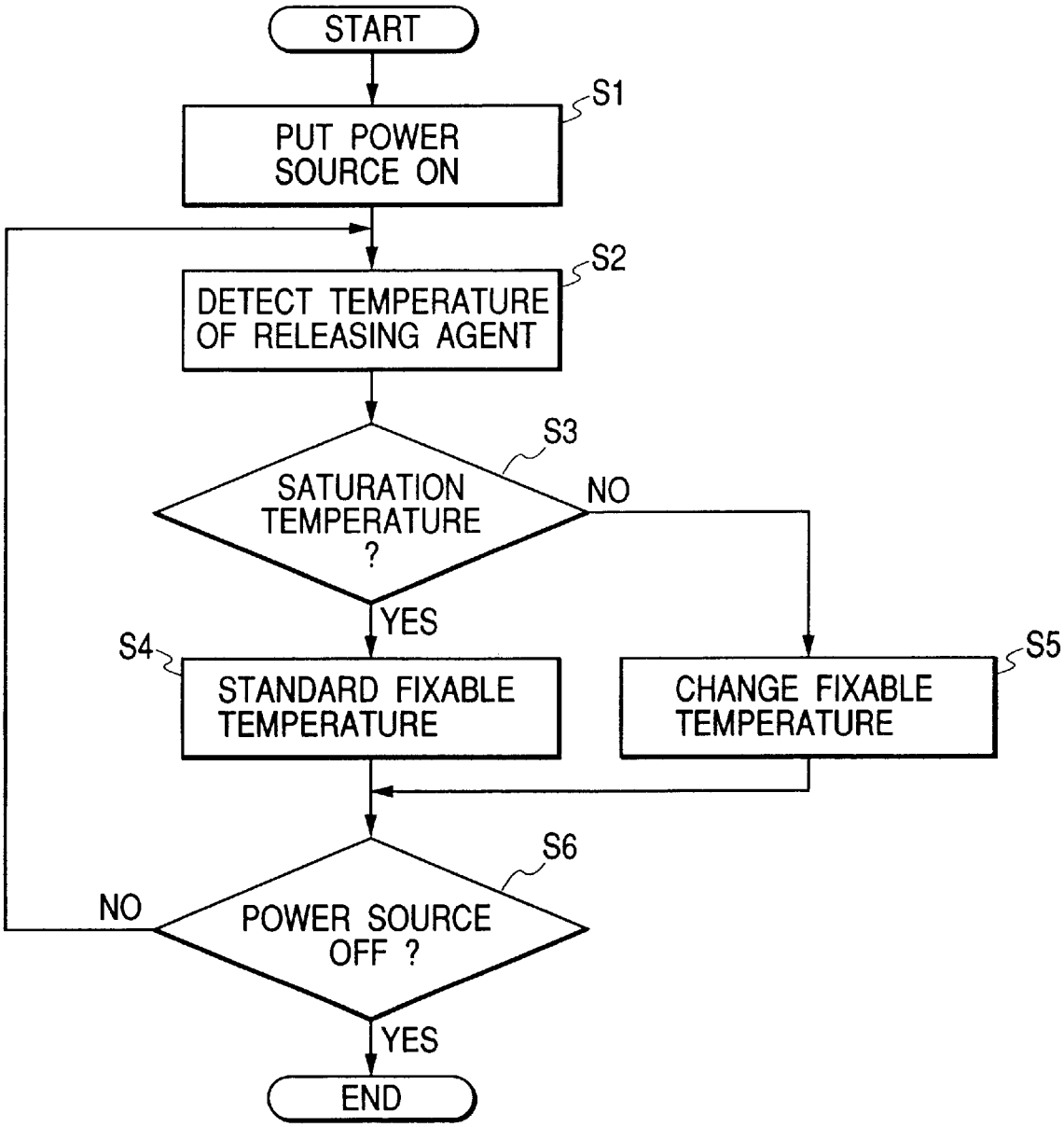
FIG. 7 is a flowchart for changing a fixable temperature.

In the present embodiment, an image forming apparatus similar to that of the aforementioned embodiment is used and a control is performed as shown in FIG. 7. Namely, in the present embodiment, similarly as the aforementioned embodiment, the thermistor 70 as the temperature detecting means is disposed in the releasing agent reservoir 53*a*, and the control is performed to change the number of fixable sheets in the state of first run in the morning (to put it concretely, a fixable temperature) in accordance with the releasing agent temperature. The fixable temperature is a little lower than a set temperature, or a lower limit value when the value of the set temperature has a width, and indicates a minimum fixable temperature.

In the conventional art, the fixing property is deteriorated in the state of first run in the morning. Therefore, in a machine, irrespective of the releasing agent temperature, continuous copying is performed for a predetermined time after the power source is turned on, the copying is stopped when the fixing roller temperature lowers down to a certain temperature, a standby state continues until the fixing roller temperature is recovered, and the copying is restarted after the recovery. However, since the fixing roller temperature state is not known in this control, the fixable temperature is uniformly determined. Even when the releasing agent temperature gradually rises and the fixing property is gradually enhanced, the fixable temperature is constant within the predetermined time from the state of first run in the morning and the number of sheets is small until the stop of the copying.

In the present embodiment, as shown in FIG. 7, similarly as the aforementioned embodiment, when the power source is put on (step S1), the thermistor 70 detects the temperature of the releasing agent in the releasing agent reservoir 53*a* at a predetermined interval (step S2). In this case, the releasing agent temperature shows a behavior similar to that shown in FIG. 3. Namely, as shown in FIG. 3 the releasing agent temperature rises in several hours and is saturated at a certain temperature. Additionally, the temperature is saturated at about 150° C. in the fixing apparatus 5 of the present embodiment.

Therefore, it is judged whether or not the releasing agent temperature detected by the thermistor 70 reaches the saturation temperature (step S3). When the saturation temperature is obtained, the fixable temperature is set to a standard fixable temperature (step S4). When the saturation temperature is not obtained, the fixable temperature is set to be higher than the standard fixable temperature (step S5). The aforementioned operation (operation of steps S2 to S5) is repeated until the power source is turned off (step S6).

As described above, the satisfactory fixing property can be obtained even in the state of first run in the morning by changing the fixable temperature in accordance with the releasing agent temperature. Here, in the state of first run in the morning the releasing agent temperature is about 30° C., and lower than the saturation temperature of 150° C. by 120° C.

Here, when copying is performed in the state of first run in the morning and the fixing temperature lowers to a predetermined fixable temperature, the copying stops, thereby entering a standby mode. In this case, by changing the fixable temperature in accordance with the releasing agent temperature, the number of copied sheets can be increased until the standby mode. In the present embodiment the fixable temperature is finely controlled in accordance with the releasing agent temperature.

Therefore, when the releasing agent temperature is low, the fixable temperature rises, thereby quickly entering the standby mode. Moreover, when the releasing agent temperature gradually increases, the fixable temperature gradually lowers. Thereby, the number of copied sheets increases before rushing into the standby mode, and the property is enhanced.

Additionally, since the releasing agent temperature and fixable temperature differ with the constitution of the fixing apparatus, these are not necessarily limited to the values described in the present embodiment.

Moreover, since the fixing property differs with the environment temperature and humidity around the machine, by further combining the detection of the temperature and humidity of the environment where the machine is placed with the present embodiment, a finer control is possible and the property is further enhanced.

The embodiments of the present invention have been described above, but the present invention is not limited to the aforementioned embodiments, and all modifications are possible within the technical scope of the present invention.

What is claimed is:

1. A fixing apparatus comprising:

a fixing member for heat-fixing an unfixed image onto a recording material;

releasing agent applying means for applying a releasing agent to said fixing member;

temperature detecting means for detecting a temperature of said releasing agent; and control means for controlling a heating condition by said fixing member based on a detected temperature of said temperature detecting means.

2. A fixing apparatus according to claim 1, wherein when the detected temperature from said temperature detecting means is lower than a preset releasing agent temperature, a fixing property by said fixing member is set to be higher than a preset standard fixing property.

3. A fixing apparatus according to claim 2, wherein with a rise of said detected temperature said fixing property is set to become gradually lower.

4. A fixing apparatus according to claim 1, wherein said heating condition is the temperature of said fixing member.

5. A fixing apparatus according to claim 4, wherein said fixing member is a roller, and includes a heat source inside.

6. A fixing apparatus according to claim 1, wherein said fixing member is movable, and said heating condition is a movement speed of said fixing member.

7. A fixing apparatus according to claim 6, wherein said fixing member is a rotating member.

8. A fixing apparatus according to claim 7, wherein said fixing member is a roller.

9. A fixing apparatus according to claim 1, wherein said heating condition is a timing of a recording material supplied to said fixing member.

10. A fixing apparatus according to claim 1, further comprising environment detecting means for detecting an environment condition, wherein said heating condition is further controlled in accordance with a detected result from said environment detecting means.

11. A fixing apparatus according to claim 10, wherein said environment condition is an environment temperature.

12. A fixing apparatus according to claim 10, wherein said environment condition is an environment humidity.

13. A fixing apparatus according to claim 1, wherein said fixing member is a heating roller, and said releasing agent applying means is in contact with said fixing member.

14. A fixing apparatus according to claim 13, wherein said releasing agent applying means includes a reservoir for containing the releasing agent, a pumping roller for pumping the releasing agent from said reservoir, and an applying for applying the releasing agent pumped by said pumping roller to said fixing member, and said applying roller is in contact with said fixing member.

15. A fixing apparatus according to claim 1, further comprising a pressurizing member for forming a nip with said fixing member, wherein the recording material bearing the unfixed image is held and conveyed by said nip, and the unfixed image is fixed onto the recording material.

16. A fixing apparatus comprising:

a fixing member for heat-fixing an unfixed image onto a recording material;

a pressurizing member for forming a nip with said fixing member;

releasing agent applying means for applying a releasing agent to said fixing member;

temperature detecting means for detecting a temperature of said releasing agent; and control means for controlling a pressure in said nip based on a detected temperature from said temperature detecting means.

* * * * *

UNITED STATES PATENT AND TRADEMARK OFFICE

CERTIFICATE OF CORRECTION

PATENT NO. : 6,487,381 B1
DATED : November 26, 2002
INVENTOR(S) : Jiro Ishizuka et al.

It is certified that error appears in the above-identified patent and that said Letters Patent is hereby corrected as shown below:

Column 4,
Line 27, “and a” should read -- and --.

Column 12,
Line 13, “applaying” should read -- applaying roller --.

Signed and Sealed this

First Day of July, 2003

JAMES E. ROGAN
*Director of the United States Patent and Trademark Office*